US007037218B2

(12) United States Patent
Lubosco et al.

(10) Patent No.: US 7,037,218 B2
(45) **Date of Patent: *May 2, 2006**

(54) PRACTICE INSERTION TIP GOLF TEE ANCHOR

(76) Inventors: Ralph Joesph Lubosco, 134 Arnold Blvd., High Bar Harbor, NJ (US) 08008; Ronald Lubosco, 10225 Thayer St., Brooksville, FL (US) 34601

( * ) Notice: Subject to any disclaimer, the term of this patent is extended or adjusted under 35 U.S.C. 154(b) by 0 days.

This patent is subject to a terminal disclaimer.

(21) Appl. No.: 10/455,056

(22) Filed: Jun. 5, 2003

(65) Prior Publication Data

US 2003/0228938 A1 Dec. 11, 2003

Related U.S. Application Data

(60) Provisional application No. 60/423,422, filed on Nov. 4, 2002, provisional application No. 60/386,806, filed on Jun. 7, 2002.

(51) Int. Cl.
*A63B 69/36* (2006.01)

(52) U.S. Cl. ..... 473/387

(58) Field of Classification Search ..... 473/386–403, 473/280, 281, 138, 139, 417, 419, 420

See application file for complete search history.

(56) References Cited

U.S. PATENT DOCUMENTS

| | | | | |
|---|---|---|---|---|
| 1,551,207 | A * | 8/1925 | Nial et al. | 473/400 |
| 1,921,523 | A * | 8/1933 | Hart | 473/281 |
| 1,979,795 | A * | 11/1934 | Clark | 473/139 |
| 3,099,452 | A * | 7/1963 | Fernicola | 473/280 |
| 4,531,734 | A * | 7/1985 | Herrick | 473/429 |
| 5,492,323 | A * | 2/1996 | Lee | 473/387 |
| 5,571,055 | A * | 11/1996 | Lewis et al. | 473/398 |
| 5,728,013 | A * | 3/1998 | Luther, Sr. | 473/396 |
| 6,358,163 | B1 * | 3/2002 | Tanner | 473/417 |
| 6,682,445 | B1 * | 1/2004 | Tanner | 473/417 |

* cited by examiner

*Primary Examiner*—Steven Wong

(57) ABSTRACT

A practice golf tee that is substantially indestructible. It includes an insertion tip at the top of the tee that goes into one of the existing holes in a practice golf ball or regulation golf ball in which hole(s) are incorporated to accommodate the insertion tip. Beneath the insertion tip the shaft increases in diameter such that the outside of the practice golf ball rests on the top of the tee. This resting point is referred to as the golf ball rest. A flexible, durable tee shaft extends down to a cylindrical and conically shaped anchor with a flat bottom. The anchor can be screwed on or off, of the pointed bottom of the tee shaft to increase portability, or be simply molded in different sizes or shapes to accomplish the portability needs of the golfer. The tee gives a perfect lie, allows for easy and stable insertion of the practice golf ball onto the top of the tee and does not need to be replaced or reset between the practice strokes of the golfer. This results in a productive and easy practice session for the golfer.

2 Claims, 4 Drawing Sheets

PRACTICE INSERTION TIP GOLF TEE ANCHOR

CROSS REFERENCE TO RELATED APPLICATIONS

The U.S. provisional patent application No. 60/386,806, title the "Practice Insertion Tip Golf Tee Anchor" Filling date Jun. 7, 2002, Confirmation No. 1428, Inventors: Ronald Lubosco; Ralph J. Lubosco.

The U.S. provisional patent application No. 60/423,422, title the "Versatile Practice Insertion Tip Golf Tee Anchor" Filling date Nov. 11, 2002, Confirmation No. 4713, Inventors: Ronald Lubosco; Ralph J. Lubosco.

| | | |
|---|---|---|
| U.S. Pat. No. 5,413,348 | May 5, 1995 | Basso; Alfonso |
| U.S. Pat. No. 6,053,822 | Apr. 25, 2000 | Kolodney; Jeffrey D./Harpaz; Zvi |

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention related to the teeing up of a wiffle practice golf ball, or a solid type practice golf ball on which holes were incorporated. Most particularly the flexible tip of the tip is inserted into the practice golf ball. The flexible, durable, and anchoring properties of the tee, allow for a continuous and productive practice session. Golf is a well know sport throughout the world and continues to grow in popularity. Golf is a demanding sport which require regular practice in order to maintain and improve the skills of the golfer.

U.S. Pat. No. 6,053,822 to Kolodney discloses the problems of a perfect lie, but does not solve the problem of having to reset the tee and environmental conditions that would affect the lie of a plastic light weight wiffle golf ball.

Conventional tees must be replace or reset every time a golf ball is hit, as is also the case with the typical wiffle type practice golf ball. Also the wiffle practice golf ball has very little mass, making it very difficult for the golfer to tee up the practice ball on a conventional tee. Considering the environmental factors such as the wind and grass a good practice lie is very difficult and tedious to accomplish.

U.S. Pat. No. 5,413,348 to Basso discloses a golf anchoring system and a flexible upper tee member for continuous use, but it does not solve the problem of a lightweight practice golf ball falling off the tee due to environmental conditions.

BRIEF SUMMARY OF THE INVENTION

The present invention is made to tee up a wiffle type practice golf ball, or a solid type practice golf ball into which holes are incorporated. The uniqueness of the invention is that it has an upper insertion tip that inserts into one of the existing holes in the practice golf ball. The tee is extremely flexible, durable, and can be anchored into the ground via it bottom anchor. The properties of the tee eliminate the need for tee replacement or tee resets between practice swings. Because the tee is inserted into the practice golf ball, a perfect lie can always be accomplished very easily, despite environmental conditions. This especially pertains to the lightweight wiffle type ball which can easily be disturbed from its lie by wind or gravity. The tee allows for an easy, enjoyable productive practice session that is easy on the golfers back and nerves.

BRIEF DESCRIPTION OF THE SEVERAL VIEWS OF THE DRAWING

FIG. 4A Top view of the preferred embodiment of the invention.

DETAILED DESCRIPTION OF THE INVENTION

Figure 1A:
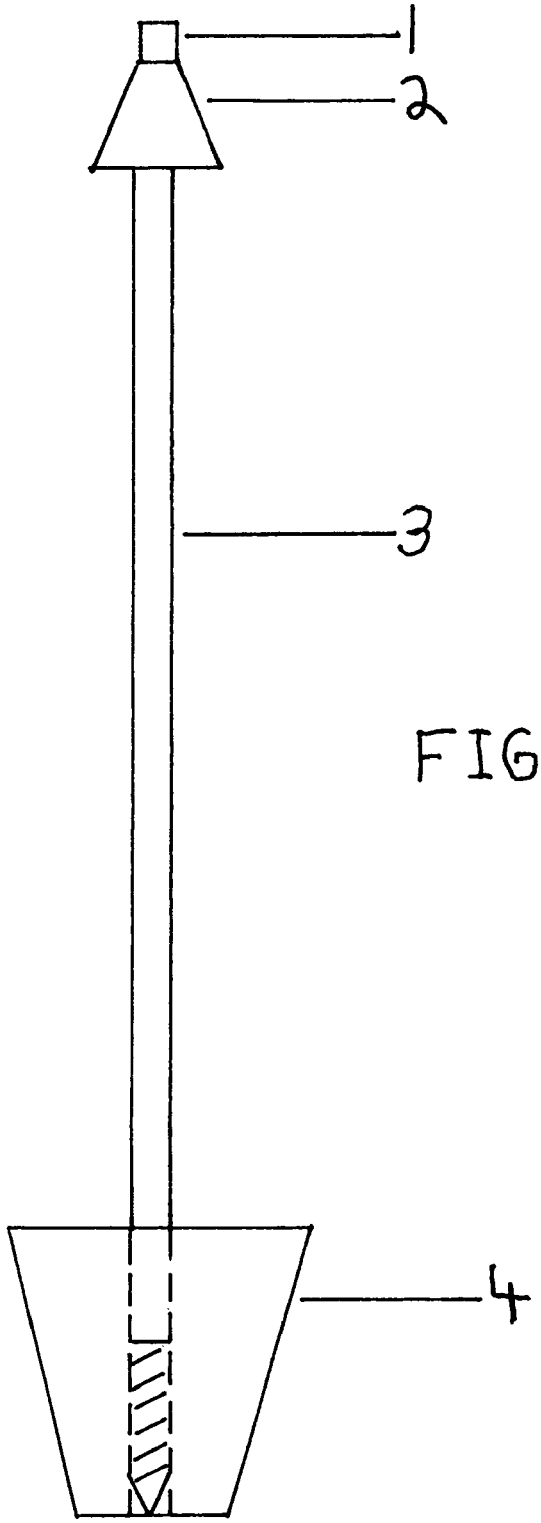
FIG. 1A Front view of the preferred embodiment of the invention. Referring to a conical insertion tip which is part of the golf ball rest. Also referring to a pointed bottom tee shaft with a screw on or off tee anchor.

FIG. 1A; Illustrates the following numbered parts of the preferred embodiment of the invention: 1; Insertion tip, is the upper tip of the tee that is inserted into the hole of the practice golf ball dimensions are approximately ⅛ inch diameter by ¼ inch length. 2; Preferred embodiment of the Golf Ball Rest which is also the impact area is located just below the insertion tip, stops the insertion tip from going into the golf ball too deeply. It is part of the insertion tip and supports the outside of the practice golf ball; dimensions are approximately 7⁄16 of an inch in diameter at the bottom, ⅛ inch diameter at the top and is conical in shape and approximately ½ inch in length. 3; Preferred embodiment of the Tee shaft, the flexible shaft located between the Golf Ball Rest and the bottom of the tee. The tee shaft is pointed at its bottom end. Dimensions are approximately ⅛ inches in diameter by 6¼ inches in length. 4; The preferred embodiment of the Tee Anchor, located at the bottom of the tee, it anchors the tee into the ground. It has ⅛ inch diameter inside threads and is approximately ½ inches up from the bottom of the anchor. This feature accommodates the bottom of the pointed tee shaft and can be screwed on or off of the bottom of the tee shaft. Dimensions are 1 inch diameter at the top, ½ inch at the bottom by 1 inch in height. It is conically shaped and is hollowed, comparable to an electric screw cap.

Figure 2A:
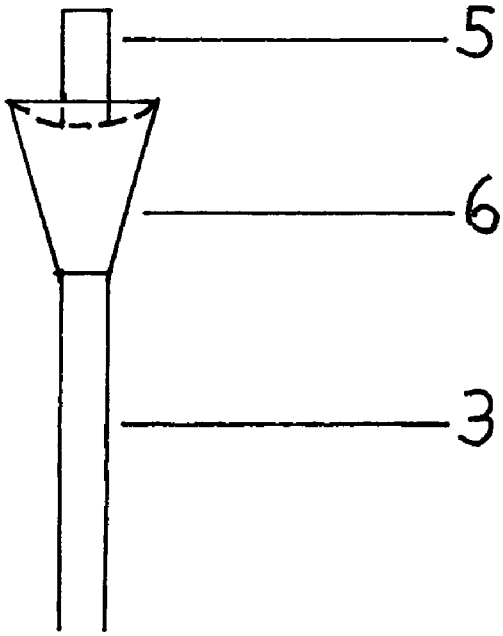
FIG. 2A Front view of the alternative embodiment of the inventions insertion tip and golf ball rest.

FIG. 2A; Illustrates a front view of the tee. 3: Tee Shaft 5; Alternative embodiment of Insertion tip that is the upper tip of the tee which is inserted into the hole of the practice golf ball. Dimensions is approximately ⅛ inch in diameter by ¼ inch in length. 6.; Alternative embodiment of the Golf Ball Rest. It is conical in shape and located approximately ¼ inch below the insertion tip. Dimensions are approximately 7⁄16 inch top diameter and ⅛ inch bottom diameter. The Golf Ball Rest is concave at the top surface which supports the practice golf ball.

Figure 3A:
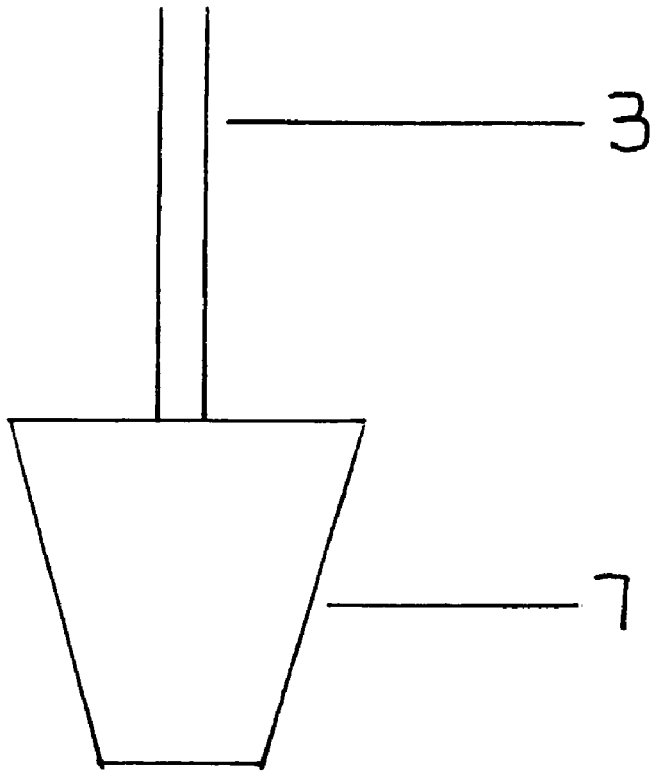
FIG. 3A Front view of the alternative embodiment of the inventions golf tee anchor.

FIG. 3A; 7; The alternative embodiment of the Golf Tee Anchor, made into one solid mold with the tee shaft.

Figure 4A:
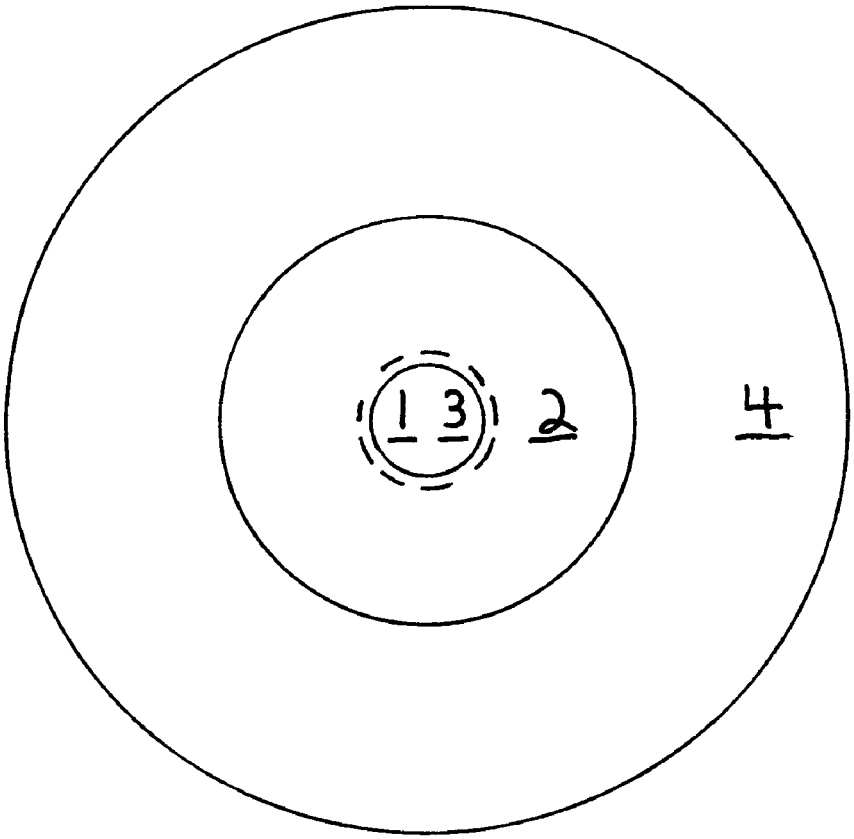

FIG. 4A: 8; It is the top view of FIG. 1A, Preferred embodiment of the Golf Tee. 1; Insertion Tip 2; Golf Ball Rest 3: Tee Shaft.

The present invention is named "THE PRACTICE INSERTION TIP GOLF TEE ANCHOR" and is referenced by U.S. Provisional Patent Application No. 60/386,806 and the U.S. Provisional Patent Application No. 60/423,422. This invention is made to tee up a wiffle type practice golf ball or a solid type practice golf ball. If the invention is used with a solid type practice golf ball, an insertion hole/holes must be incorporated into the solid golf ball. These holes must be drilled or molded to accommodate, in a loose fit manor, the insertion tip of the Practice Golf Tee Anchor such that minimal resistance would occur as the golf ball departed the tee upon impact from the golf club head. In this invention the practice ball does not rest solely on top of the tee. Instead the tee with an approximate ⅛ inch diameter flexible shaft is inserted loosely into one of the existing approximate (¼, ⅜) diameter inch holes of the practice golf ball to a depth of approximately ¼ inch. The golf tee shaft increases to approximately 7⁄16 to ½ inch diameter immediately following the ¼ inch length insertion of the tip of the golf tee. This increased diameter of the golf tee shaft acts as a rest for the outside surface of the practice ball and I will refer to it as the golf ball rest. The rest is approximately ½ inch in length and can be flat, concave, convex or conical in relation to the outer surface of the practice golf ball. The conical version is the preferred embodiment, in this case the smaller end of the cone inserts into the practice golf ball. Thus the insertion tip and the golf ball rest are one entity. The entire golf tee is approximately 6½ inches in length. The shaft is anchored via the bottom of the tee. The anchor length from the bottom of the tee upwards is approximately one inch. The diameter at the top of the anchor is approximately one inch. The diameter at the bottom of the anchor is approximately ½ inch. The anchor is conically shaped and uniformly encircles the approximately ⅛ inch flexible shaft, which is the vertical axis of the tee. If the tee is made via a mold into one single entity, the approximately ⅛ inch flexible shaft would be an imaginary axis in relation to the vertical length of the practice ball rest and the anchor. All tee dimensions could be changed but would be considered to be within the scope of the invention The Manor and Process of Making and Using the Invention This invention as mentioned above can be made into one molded piece that includes the approximate ⅛ inch flexible shaft, the insertion tip, the practice golf ball rest, and the anchor. The flexibility, durability, and hardness characteristics of a singly molded tee would have the same physical properties as the ⅛ inch diameter weed trimmer line or cord. The preferred color of the tee would be white to enable easy insertion of the practice golf ball onto the Practice Insertion Tip Golf Tee Anchor via eyesight, although any color could be used.

The second method of creating the invention would be to cut a length of the approximate ⅛ inch diameter trimmer line to an approximate 6½ inches. Then add the golf ball rest via a waterproof durable type of adhesive tape. The conical version of adding the tape is preferred. Then to add the anchor via an electrical screw type wire cap, used in electrical wiring frequently. By adding a pointed end to the bottom of the tee shaft, the electrical screw cap could be unscrewed to increase portability and screw back on to increase stability.

If the second method is used the golf ball rest could also be added by rasping or roughing up the surface of the area that it will be located on. Then applying glue using a glue gun or a resilient type of epoxy glue to make the golf ball rest. The latter roughing procedure could also be used with the adhesive type tape also previously mentioned. The golf ball rest could also be made using a smaller electrical screw cap that had its tip cut off with the appropriate outside and inside (thread) dimensions. This would allow the golf ball rest to be screwed and glued onto the tee shaft at the appropriate height.

Combination of the above methods of making the tee may also be used in conjunction with each other to reproduce the invention. Many other methods of reproducing the tee are possible but this would be considered to be within the scope of the invention The scope of this invention allows for a stable teeing up of a featherweight wiffle type, practice golf ball, or a modified regular weight golf ball into which insertion holes were incorporated. The stability and ease of teeing up the practice golf ball would be much greater than the convention type golf tee. Even in sandy soil, windy, rainy, sunny, darkened or uneven ground conditions, the advantage of teeing up would be much greater for the golfer.

The advantage exists because of the insertion tip on the golf tee, which is unique to the invention. The insertion tip allows the wiffle practice golf ball to be set on the tee feathered in grass. This would be hard to accomplish with the head of a conventional tee because of the small mass of the hallowed practice golf ball. In reference to the solid type modified golf ball a consistent lie, simulating actual tee off conditions, with the golf ball being feathered in grass would be a great advantage on golf driving ranges. Mat and mat tees used on a regular basis on the driving ranges do not simulate the grass and conventional tee combination used in game situations. Conventional tees used in practice on and off the driving range have the disadvantage of continuous replacement. The flexible and anchoring properties of the invention would allow for continuous practice without repositioning the tee. The insertion dimension differentials between the approximate (¼, ⅜) inch hole in the practice golf ball and the approximate ⅛ inch diameter flexible golf tee shaft, along with the anchoring properties of the tee, will allow for a resistance free take off in the flight of the practice golf ball. This will greatly imitate that of a conventional hit regulation golf ball. The practice golf ball will hook, slice, or travel in a straight trajectory. The golfer who is practicing will be able to adjust the power and position of his or her swing accomplishing the goal of driving the practice golf ball in a straight trajectory, with respect to the horizontal and vertical. These adjustments will carry over to the actual game situation.

To use the Practice Insertion Tip Golf Tee Anchor in your own back yard, allow about 100 feet for driving the wiffle type practice golf balls. The practice tee should be adjusted to the golfers desired height. I would recommend that the tee height would simulate actual tee off conditions. It may be necessary to punch a hole in the soil depending on the soil conditions in order to place the tee anchor into the soil. Remember the tee anchor bottom is flat to help ensure the stability of the entire tee apparatus. Once the tee is placed at the desired height, tamp the soil around the tee with your foot, and the tee will be ready for continuous practice. Use the holes in the practice ball as the point of insertion onto the tee. The hardness characteristic of the impact area on the tee, are such that it will not damage the golf club. When using the tee to drive modified regulation type golf balls, driving range type areas are needed for safety reasons. The tee would otherwise be prepared for practice or game condition in the same manor as stated above. Note the tee anchor can also be removed and the tee shaft can be shortened by simply cutting the tee shaft at the golfer's preference.

The invention is subject to dimensions and shape changes with respect to the insertion tip, tee shaft, golf ball rest and anchor. It is also possible that different sizes, shapes, materials, mechanical ways and combinations as such could be used to recreate the invention. This would be considered to be within the scope of the invention. The scope of the invention idea is that the invention brings forth a new way to tee up practice golf balls, using the idea of an insertion tip method. The new idea of an insertion tip combined with anchoring, flexibility, durability, hardness, and color characteristics of the tee make it very versatile, portable, or non portable (anchored permanently). The tee could also conceivably be used to play the game of golf if a mutual agreement between players existed, such that a modified regulation golf ball (insertion hole/holes in the golf ball) would be allowed in the game. This would apply especially at the non-professional level.

We claim:

1. A practice golf tee for providing continuous practice without replacing, removing or resetting the tee, comprising:

a) a golf ball having an insertion hole, b) a flexible, durable insertion tip for insertion into the insertion hole of the golf ball;

c) a flexible, durable golf ball rest having a diameter greater than that of the insertion tip for restricting the depth that the insertion tip is inserted into the golf ball and providing a resting place for the outside surface of the golf ball;

d) a flexible, durable tee shaft extending from the golf ball rest, the tee shaft having a pointed end;

e) a tee anchor for retaining the tee in the ground, the tee anchor having threads for threadingly engaging the end of the tee shaft.

2. A practice golf tee for providing continuous practice without replacing, removing or resetting the tee, comprising:

f) a golf ball having an insertion hole, g) a flexible, durable insertion tip for insertion into the insertion hole of the golf ball;

h) a flexible, durable golf bail rest having a diameter greater than that of the insertion tip for restricting the depth that the insertion tip is inserted into the golf ball and providing a resting place for the outside surface of the golf ball;

i) a flexible, durable tee shaft extending from the golf ball rest, the tee shaft having a pointed end;

j) a tee anchor for retaining the tee in the ground, the tee anchor being integrally molded to the end of the tee shaft.

* * * * *